US006328472B1

(12) United States Patent
Laurence et al.

(10) Patent No.: US 6,328,472 B1
(45) Date of Patent: Dec. 11, 2001

(54) BAG APPARATUS WITH RECLOSABLE POUR SPOUT

(75) Inventors: James B. Laurence, Barrington, IL (US); Bruce Bartles, Excelsior Springs; Morris Crosby, Belton, both of MO (US); Steve Wiggins, Shawnee, KS (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/640,679

(22) Filed: Aug. 18, 2000

(51) Int. Cl.[7] ..... B65D 33/18

(52) U.S. Cl. ..... 383/211; 383/86; 383/203; 383/205; 383/906

(58) Field of Search ..... 383/205, 203, 383/211, 86, 906

(56) References Cited

U.S. PATENT DOCUMENTS

| | | | | |
|---|---|---|---|---|
| 4,441,613 | | 4/1984 | Hain et al. . | |
| 4,471,875 | | 9/1984 | Hain et al. . | |
| 4,480,752 | | 11/1984 | Jacobs . | |
| 4,512,479 | | 4/1985 | Hain et al. . | |
| 4,567,987 | | 2/1986 | Lepisto et al. . | |
| 6,048,100 | * | 4/2000 | Thrall et al. | 383/203 X |
| 6,068,403 | * | 5/2000 | Schneck | 383/211 X |
| 6,120,184 | * | 9/2000 | Laurence et al. | 383/203 X |

FOREIGN PATENT DOCUMENTS

| | | |
|---|---|---|
| 618 934 | 8/1980 | (CH) . |
| 929 115 | 6/1955 | (DE) . |
| 0 400 826 | 12/1990 | (EP) . |

* cited by examiner

*Primary Examiner*—Jes F. Pascua
(74) *Attorney, Agent, or Firm*—Dick and Harris

(57) ABSTRACT

A bag for the containment of fluent material, having an openable and reclosable pour spout. The bag includes a tubular bag body, and at least one flattened end forming a bag mouth. A closure flap emanates from one side of the bag mouth, to be folded over across the mouth to close the bag. A spout structure is affixed to an outer surface of one of the sides of the bag mouth. The spout structure includes a base sheet affixed to the bag body, and a spout flap releasably affixed to the base sheet. Upon sealing of the bag end, the spout flap becomes non-releasably affixed to an inside portion of the closure flap of the bag body. The spout flap is separable from the base sheet, via a first adhesive material is affixed to one or both of the spout flap and base sheet, for enabling repeated opening and reclosing of a portion of a portion of the bag mouth at the spout flap.

14 Claims, 3 Drawing Sheets

BAG APPARATUS WITH RECLOSABLE POUR SPOUT

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention is directed to bags of one or more layers, wherein at least one layer may be fabricated from paper or plastic material, for the containment and dispensing of fluent material.

2. Description of the Related Art Including Information Disclosed under 37 CFR 1.97 and 1.98

Bags for the containment and dispensing of fluent material, such as dry dog food or cat litter, which are fabricated from one or more layers, wherein at least one layer may be fabricated from paper or plastic, are well known. One such type of bag is known as a stepped-end, folded-over, pinch bottom bag (hereinafter "pinch bottom bag").

Such a bag may be fabricated from one or more layers of plain, untreated paper, although typically, one or more layers may be fabricated from a fine-grain, siftproof paper. In addition or alternatively, one or more of the layers may be fabricated from an inherently moisture-proof material, such as polyethylene, or treated paper. The several layers of the bag are aligned atop one another and, while still in a continuous web, formed into a tube. As the tube is cut into individual bag tubes, the ends of each bag tube may be cut in a stepped fashion, to create a stepped progression of layers on both sides of the opening of such a flattened bag. The exposed mating stepped surfaces of one or both sides may be provided with a heat-sealable coating or may themselves be heat-sealable (in the case of polyethylene layers).

Typically, the "top" of the bag (the end the ultimate product customer opens) is folded over, and passed through a heat-sealing device to close an end of the bag. The opposite end of the bag (usually the bottom) is left open by the bag manufacturer, so that the customer of the bag (the product producer) can fill the bag with product, and then seal the bag.

In the simplest form of such a bag, once both ends have been sealed shut, the bag can only be opened by tearing or cutting. Once opened, the sealed condition of the bag is lost, and the contents are exposed to air, humidity, spillage, and the possibility of intrusion of contaminants, etc. If not all of the contents are to be used at once, the only options for reclosure of the bag, are folding or rolling down the opened top, or using some kind of cinch closure (twist-ties and the like). Alternatively, if a greater degree of protection for remaining unused contents is required, usually, the contents must be tipped into a reopenable/resealable container, such as a lidded metal or plastic drum or the like.

Accordingly, it would be desirable to provide a multi-layer bag, for example, of the stepped-end, pinch bottom variety, which is susceptible of opening, without having to excessively tear or cut the material of the bag, so that the bag is capable of substantially truly sealable reclosure in a facilitated manner.

It would further be desirable to provide a multi-layer bag, for example, of the stepped-end, pinch bottom variety, which is provided with a spout or opening, which can be opened and closed repeatedly, until all of the contents of the bag have been dispensed from the bag.

These and other objects of the invention will become apparent in light of the present description, claims and drawings.

BRIEF SUMMARY OF THE INVENTION

A bag apparatus, having a repeatedly openable and reclosable pour spout, comprises a tubular bag body, fabricated from at least one layer of bag material, in which the tubular bag body has at least one end configured to form an open mouth and having first and second opposing sides adjacent the mouth. A closure flap emanates from the first of the opposing sides of the mouth, and is operably configured to be folded across the mouth and over at least a portion of an outer surface of the second of the opposing sides of the mouth.

The closure flap has an inside surface operably configured to be placed in juxtaposed alignment over the at least first portion of the outer surface of the second of the opposing sides of the mouth.

A spout structure is operably affixed to a portion of the outside surface of the tubular bag body, including a base sheet, operably positioned on and over at least a further portion of the portion of the outer surface of the second of the opposing sides of the mouth, the base sheet having an outside surface; a spout flap, operably disposed in substantially aligned overlying contact with the base sheet; and a first adhesive material operably disposed on at least one of the inside surface of the spout flap and the outside surface of the base sheet, the first adhesive material being operably disposed to releasably hold the spout flap to the base sheet, after the spout flap and the base sheet have been brought into the substantially aligned overlying contact with each other.

The spout structure is operably disposed on the further portion of the portion of the outer surface of the second of the opposing sides of the mouth, so that upon operable positioning of a second, substantially non-releasable adhesive material upon the inside surface of the closure flap and further upon the juxtaposed alignment of the closure flap over and against the portion of the outer surface of the second of the opposing sides of the mouth, the spout flap becomes non-releasably affixed to a portion of the inside surface of the closure flap.

Complete separation of the spout flap from the base sheet enables a portion of the mouth of the bag to be reopened for providing access to an interior region of the tubular bag body, the first adhesive material permitting the spout flap and base sheet to be repeatedly separated and releasably reattached to one another, to, in turn, permit at least a portion of the mouth to be repeatedly opened and reclosed.

The spout flap preferably further comprises at least first and second flap sheets laminated to one another. The at least first and second flap sheets may be fabricated from different materials.

The first adhesive material is preferably disposed to remain on the spout flap, upon separation of the spout flap from the base sheet. Alternatively, the first adhesive material may be disposed to remain on the base sheet, upon separation of the spout flap from the base sheet.

The base sheet preferably comprises a sheet, fabricated from a polymer-based material.

The first adhesive material preferably comprises at least one material from the group consisting of polyesters, polyethylenes, polyamids.

The spout structure is preferably operably disposed upon the further portion of the portion of the outer surface of the second of the opposing sides of the mouth so that, after the juxtaposed alignment of the closure flap over the portion of the outer surface of the second of the opposing sides of the mouth and non-releasable affixation of the spout flap to the closure flap, upon initial separation of the spout flap and the base sheet, and upon continued pulling of the spout flap, a portion of the closure flap, to which the spout flap is non-releasably affixed, becomes partially separated from a remaining portion of the closure flap, for facilitating partial opening of the mouth of the bag.

Preferably, portions of the inside surface of the spout flap and of the base sheet are left free of the at least one adhesive material, so that an object may be inserted between the portions of the inside surface of the spout flap and the base sheet, for facilitating grasping of the spout flap, toward permitting pulling of the spout flap away from the base sheet.

The bag body is preferably formed from a plurality of layers of bag material. In a preferred embodiment of the invention, at least one of the layers of bag material is fabricated from paper. In an alternative embodiment of the invention, at least one of the layers of bag material is fabricated from a plastic material.

The bag body may be gusseted. Further, the bag body may be fabricated from a plurality of layers of bag material, with the at least one end of the bag being cut to form a stepped end.

BRIEF DESCRIPTION OF THE SEVERAL VIEWS OF THE DRAWING(S)

DETAILED DESCRIPTION OF THE INVENTION

Figure 1:
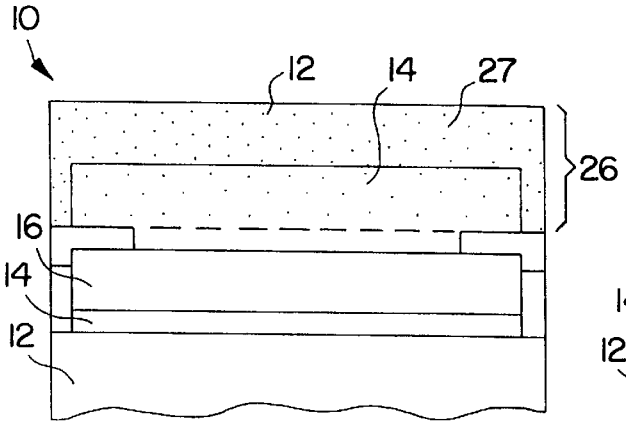
FIG. 1 PRIOR ART
FIG. 1 is a front elevation of a substantially flattened, prior art, multi-layer, stepped-end, pinch bottom bag, which is unsealed.

While this invention is susceptible of embodiment in many different forms, there is shown in the drawings and will be described in detail herein, a specific embodiment, with the understanding that the present disclosure is to be considered an exemplification of the principles of the invention and is not intended to limit the invention to the embodiment illustrated.

Figure 3:
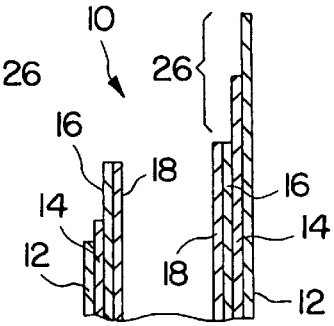
FIG. 3 PRIOR ART
FIG. 3 is a side elevation, in section, of the prior art bag of FIGS. 1 and 2, taken along line 3—3 of FIG. 2.
Figure 2:
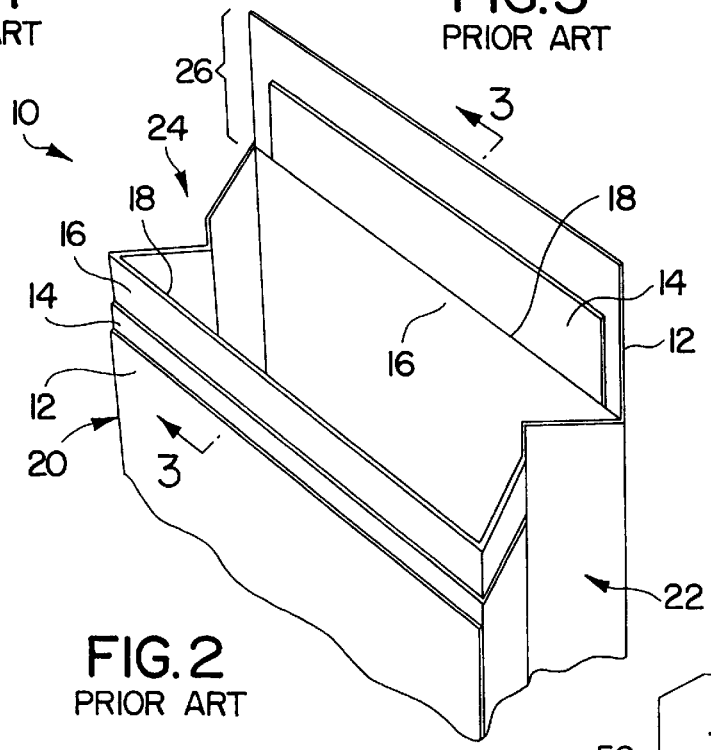
FIG. 2 PRIOR ART
FIG. 2 is a top perspective view of the prior art bag of FIG. 1, partially spread open.

FIGS. 1–3 illustrate one end of a prior art stepped-end cut, multilayer pinch bottom bag 10. Typically, both ends of the bag are substantially identical in the manner in which the ends are stepped. Accordingly, only one end is illustrated. Bag 10 has four layers 12, 14, 16 and 18 (though greater or fewer layers may be provided), which are formed from webs and rolled into a tube body 20, in the conventional manner known in the art. Typically, at least one of the layers is fabricated from paper material. Often, one or more layers of the bag may be fabricated from a plastic material, such as polyethylene. When tube body 20 is flattened, two side gussets 22 and 24 may be formed. These in-folded gussets 22, 24 are retained, when the "top" of the bag is sealed shut, for transportation of the bag to the customer for filling with product.

To enable sealing of the bag, the "inside" surfaces of the layers forming the "flap" portion 26 of the open end may be coated with a heat- or sonically-activatable material 27, indicated by the stippling in FIG. 1. The closure flap 26 may be folded over, and the heat or ultrasonic vibrations applied, to activate the glue. After filling of the bag, the same procedure may be applied to the "customer" end of the bag. Alternatively, a hot melt glue may be applied and the closure flap 26 folded over while the glue is still tacky.

As described elsewhere herein, once both ends of the bag have been folded over and sealed, in order to gain access to the materials inside of the bag, the bag material itself be pierced, cut or torn, thus leaving a non-sealable, and virtually non-closable remnant. This may be acceptable, if the entirety of the contents of the bag is to be used at once, or if spillage, contamination or other degradation of the contents are not critical. However, if an unused portion will be left, such as in the case of dry dog or cat food, or moisture or humidity-sensitive materials, such as cement or plaster mixes, among other possible examples, then the contents might become moldy, stale or otherwise compromised, via exposure to air, moisture and/or intrusion of contaminants.

The multilayer bag of the present invention, illustrated in FIGS. 4–10, addresses such problems. Bag 50, apart from the reclosable spout components described hereinafter, may have a construction substantially identical to the bag illustrated and described with respect to FIGS. 1–3. The bag may be fabricated entirely from layers of paper, entirely from layers of plastic or any combination thereof. Typically, both ends of bag 50 may be substantially identical in the manner in which the ends are stepped. Therefore, only one end of bag 50 is illustrated. Bag 50 may have four layers 52, 54, 56 and 58 (though a greater or lesser number of layers may be provided), which are formed from webs and rolled into a tube body 60, in the conventional manner known in the art. Preferably, innermost layer 58 is a plastic material that may or may not be heat sealable. When tube body 60 is flattened, two side gussets 62 and 64 may be formed. These in-folded gussets 62 and 64 are retained, when the "top" of the bag is sealed shut, for transportation of the bag to the customer for filling with product.

Figure 5:
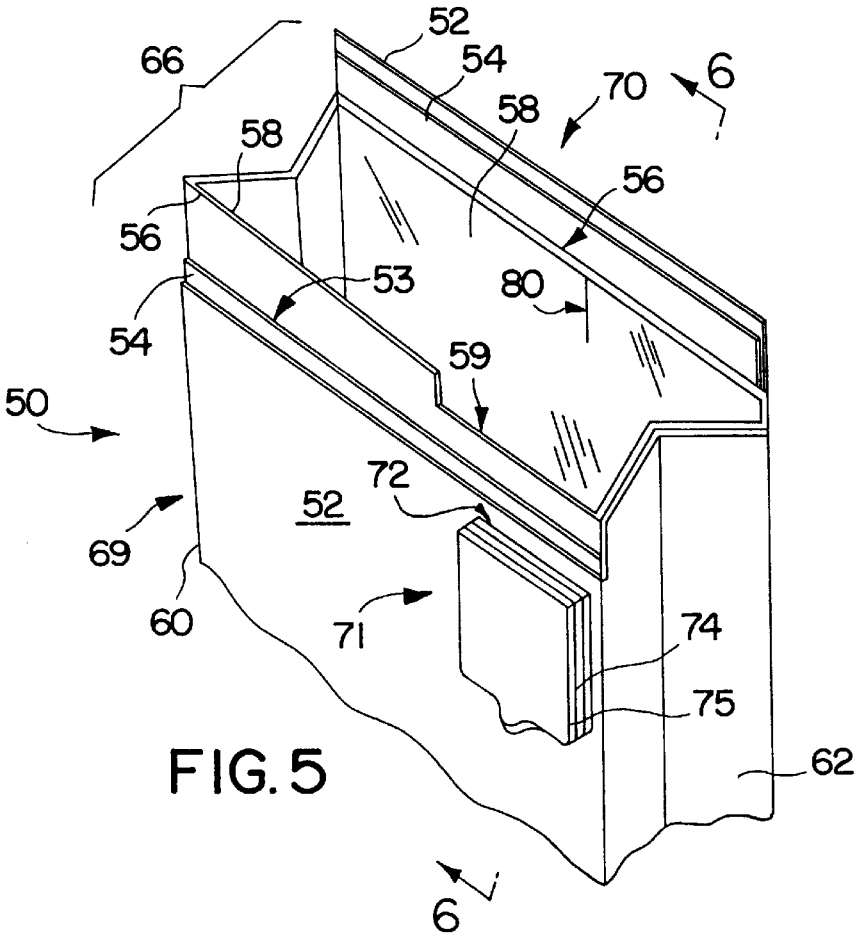
FIG. 5 is a top perspective view of the bag of the present invention of FIG. 4, partially spread open.

The open end of the substantially flattened bag 50 defines a mouth 68, formed by the short step 69 (the stepped-cut portions of the front side of the bag, as seen in FIG. 5) and the long step 70 (the stepped-cut portions of the back side of the bag, as seen in FIG. 5). Closure of the end of the bag involves folding the closure flap 66, which is formed by upper portions of short step 69, and exposed portions of long step 70. Folding of closure flap 66 involves folding a portion of short step 69 upon itself. A rectangular cut 59 is provided in layers 56 and 58 of the short step 69, so that when the long step 70 is folded over, layer 58 of the long step is affixed to flap sheet 75 of spout structure 71.

Figure 4:
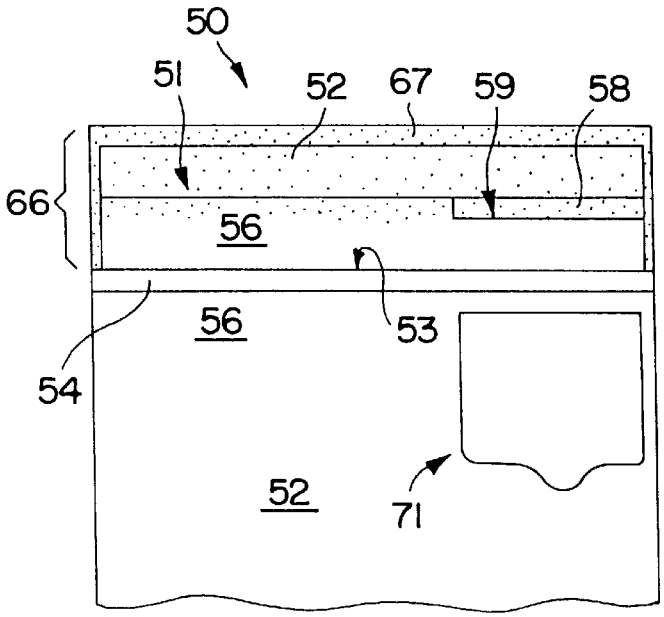
FIG. 4 is a front elevation of a substantially flattened, multi-layer, stepped-end, pinch bottom bag, with reclosable pour spout according to the principles of the present invention.

To enable sealing of the bag, the "inside" surfaces of the layers forming the "flap" portion 66 of the open end may be coated with a heat or sonically activatable material 67, indicated by the stippling in FIG. 4 only. Heat or sonically activatable material 67 is preferably a polyethylene-based hot melt applied adhesive, although other materials having similar operational characteristics may be employed. The adhesive preferably covers the entire height of long step 70, above the top edge 51 of short step 69 (which defines the mouth 68, as seen from the side), but only a portion of the short step 69, stopping well above fold line 53, located at approximately the top edge of layer 54 of short step 69. Specifically, preferably, when the adhesive 67 is applied, it will preferably extend down the exposed surfaces of the short and long steps, to about the bottom of cut 59. The closure flap 66 may be folded over, and the heat or ultrasonic vibrations applied, to activate the glue. Typically, the bag end shown in FIGS. 4–10 is the end that is closed and sealed, prior to shipment of the bag to the bag customer (packager). After filling of the bag, the same procedure may be applied to the "customer" end of the bag. Alternatively, a hot melt glue may be applied and the closure flap 66 folded over while the glue is still tacky.

Figure 7:
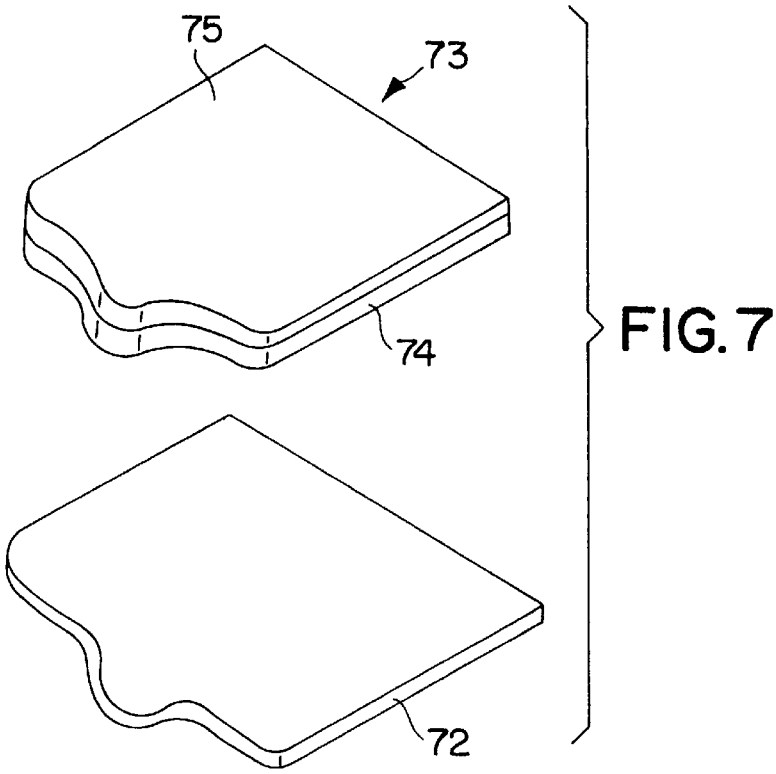
FIG. 7 is a perspective exploded view of the reclosable spout structure of the present invention, according to one preferred embodiment.
Figure 8:
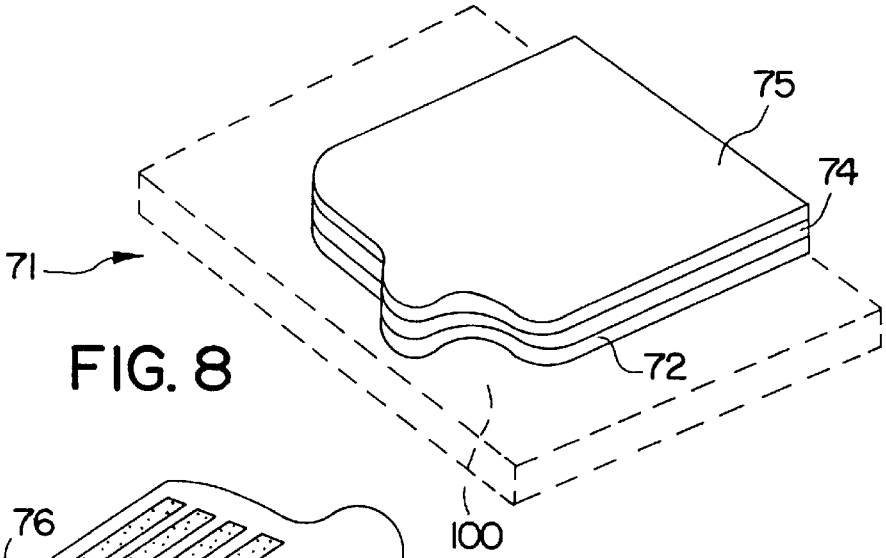
FIG. 8 is a perspective view of the reclosable spout structure of the present invention, according to the embodiment of FIG. 7.

Reclosable spout structure 71 of bag 50, according to a preferred embodiment of the present invention, as shown in particular detail in FIGS. 7 and 8, incorporates base sheet 72 and spout flap 73. base sheet 72 is preferably fabricated from a polymer material, such as polyester or Mylar®, for example. Spout flap 73 is a laminated structure that may include first flap sheet 74 (which may likewise be fabricated from a polymer material, such as polyester or Mylar®). Second flap sheet 75 preferably may be fabricated from a paper material, such as a bleached, semigloss, clay-coated paper, of the type known in the industry as C1S. Preferably, flap sheet 74 and flap sheet 75 are laminated together in a substantially permanent manner, to resist separation, during ordinary use of the reclosable spout structure.

Figure 11:
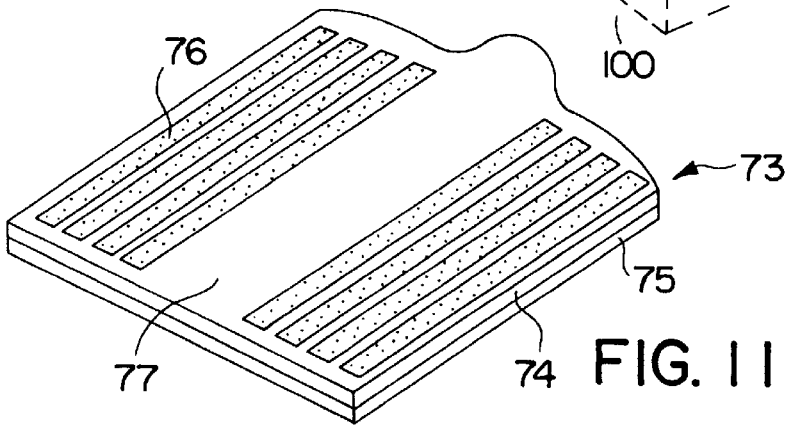
FIG. 11 is a perspective view of the spout flap, from the bottom, showing the pattern of adhesive material.

In order to provide releasable adhesion of first flap sheet 74 to base sheet 72, an adhesive material 76 is applied to the underside surface of first flap sheet 74, the side that becomes juxtaposed to base sheet 72. See, e.g., FIG. 11. Adhesive material 76 is applied in a pattern of thin, elongated stripes, which are spaced apart. A gap 77 in the stripes, is provided, so that when sheet 74 is releasably affixed to base sheet 72, a finger or implement may be inserted between sheet 72 and sheet 74, at the location of the gap, to facilitate grasping and separation of sheets 74 and 75, from sheet 72. While only four stripes of adhesive 76 are shown on each side of gap 77, preferably a substantially greater number of stripes, e.g., about 20 or so, are provided, on each side of gap 77, with each stripe having a width on the order of 1/16 inch. The stripes are preferably separated by narrow gaps, which may be on the order of 1/32 inch. The adhesive material itself may be fabricated from a polymer adhesive material, such as a polyester, a polyethylene or a polyamid. It is believed that the stripe-gap-stripe pattern contributes to the releasability of sheet 72 from sheet 74.

Figure 6:
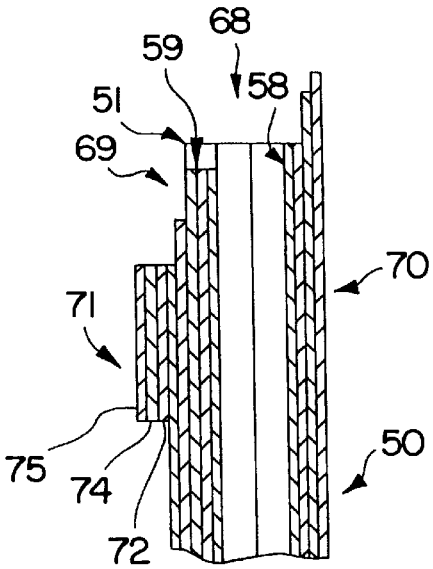
FIG. 6 is a top perspective view of the bag of the present invention of FIGS. 4 and 5, taken along line 6—6 of FIG. 5.

Preferably, spout structure 71 is fabricated as a single unit, for example with sheets 72, 74 and 75 beginning as elongated webs which are joined together, with permanent adhesive joining the webs forming sheets 74 and 75 and the patterned adhesive 76 joining the webs forming sheets 74 and 72, to form a single elongated web, which is then rolled into a coil. Such materials are presently commercially available (with or without the web forming sheets 75), for example, from 3 Sigma LLC, 1985 W. Stanley Road, Troy, Ohio 45373-2330. Afterward, the roll is then cut and/or split into separate "labels", which, in the present invention, are applied, using conventional label applying techniques and equipment, to the outer surfaces of the bags, as shown in FIGS. 4–6. The adhesive that is used to affix spout structure 71 to bag 50 preferably is a permanent adhesive, such as an adhesive hot melt or an acrylic adhesive, such as polyvinyl acetate or polyvinyl alcohol.

Sheet 75 may be provided, constituted as described hereinabove, to permit its upper exposed surface to receive printing, for example "how to open" type instructions, etc. In addition, beneath base sheet 72, a sheet of paper, such as 40# kraft paper, may be provided, that is directly affixed to the face surface of the bag. Such an optional further base sheet 100 is shown, in broken lines, in FIG. 8.

In a preferred embodiment of the invention, as shown in the figures, flap sheet 74, flap sheet 75 and base sheet 75 are all cut with substantially the same shape and dimensions, for forming integrated spout flap 73. Alternatively, base sheet 72 may be cut, during the "label" forming process of cutting the individual spout structures 71, from the roll of material, to have a similar shape but slightly larger dimensions than spout flap 73. This would result in a peripheral gap between the edges of spout flap 73 and base sheet 72.

In a preferred embodiment of the invention, during manufacture of the bags, a plurality of otherwise conventional bags 50 are fabricated in a manufacturing line, using known manufacturing techniques and apparatus. Spout structures 71 are fabricated, as previously described, as integrated pre-assembled units (per FIG. 8) and affixed, in succession, to the fabricated bags 50, in a manner similar to that by which labels are "blown" onto bag structures, using known label applying techniques and apparatus.

FIGS. 4–6 illustrate a completely fabricated bag, with reclosable pour spout structure, according to a preferred embodiment of the invention, prior to final closing of the manufacturer's end of the bag. After affixation of spout structures 71, closure flap 66 is closed, leaving the opposite end of the bag open, for filling by the bag customer and subsequent sealing for distribution to the vendors and ultimate consumers.

The completed bag 50, with spout structure 71 in place, is shown in FIGS. 4–6. Prior to transmittal of the bag to a customer for filling, closure flap 66 is folded over and sealed. When adhesive 67 is applied or activated, and flap 66 is folded over, the portion of layer 58 of the long step 70, that is exposed by cut 59, contacts and becomes affixed to the uppermost portion of flap sheet 75. The portions of the short step 69, that are between the top edge of flap sheet 75 and the bottom edge of cut 59 are, by virtue of the described placement of adhesive 67, substantially untouched by adhesive. In addition, flap sheet 75 is attached by adhesive, preferably not to any part of the short step 69, but instead to the long step 70.

Figure 9:
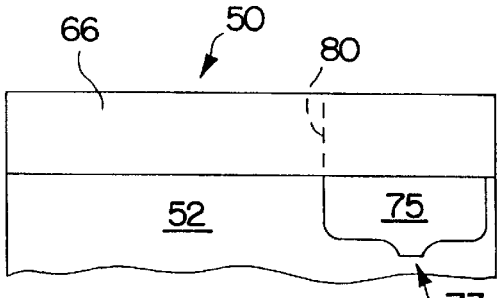
FIG. 9 is a front elevation of the bag of the present invention of FIGS. 4–8, after the end of the bag has been sealed, but before initial opening by a user.
Figure 10:
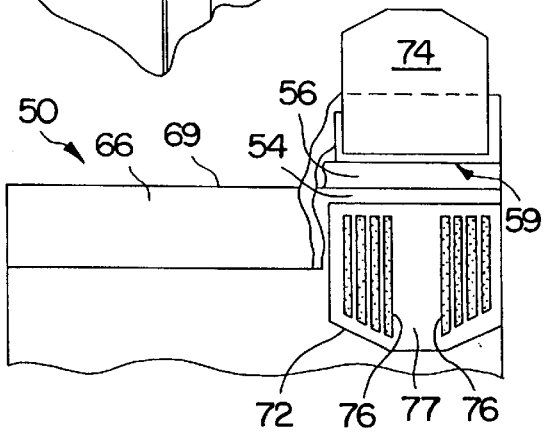
FIG. 10 is a front elevation of the bag of the present invention of FIGS. 4–9, after the end of the bag has been sealed, and after the spout of the bag has been initially opened.

The operation of opening bag 50 is demonstrated in FIGS. 9 and 10. The opposite end of the bag is still open. The bag is then transmitted to the "customer" who will fill the bag with product, and then close the end opposite the end having spout structure 71. FIG. 9 illustrates the end of bag 50, when fully closed. As mentioned above, by inserting a finger or an implement between base sheet 72 and flap sheet 74, at gap 77 (see FIG. 11), flap sheets 74, 75 may be grasped and pulled away from base sheet 72. When the bag is fully closed, a blade or fingernail may be inserted between base sheet 72 and spout flap 73, to "pry up" the spout flap 73 from base sheet 72. Gusset 22 is freed, and a portion of mouth 68 is exposed, permitting access to the interior of the bag. Specifically, a portion of the mouth 68, defined by the short step by the bottom edge of cut 59 of layers 56, 58, and by the torn portion of the long step 70, and attached flap sheets 74, 75. See FIG. 10. Adhesive 76 will remain attached to the underside of sheet 74. The adhesive connecting base sheet 72 to the bag (or, if sheet 100 is used, the adhesive between sheet 100 and the bag, and between sheet 72 and sheet 100) must be sufficiently strong to prevent separation of sheet 72 from the bag (or prevent separation of sheet 100 from the bag and/or prevent separation of sheet 72 from sheet 100), as sheets 74, 75 are pulled up away from sheet 72. Preferably, adhesive 76 is sufficiently durable so that it will permit repeated separations and re-affixations of sheets 74 and 72. After the initial opening, gusset 22 is pulled out, and the opening thus forms an open pouring spout.

In the embodiment of FIGS. 9 and 10, the first opening of bag 50 results in a partial tearing of the closure flap 66 adjacent the inside edge of the spout flap 73. To provide a more controlled opening of the bag mouth 68, cuts 80 may be placed in layers 58, 56 of long step 70, at a transverse position substantially aligned with the vertical edge of cut 59, and having a height substantially equal to the vertical edge of cut 59. Cuts 80 also reduce the total number of layers, which must be initially torn.

Reclosing and resealing of bag 50 becomes a simple matter of refolding spout flap 73 back down onto and against base sheet 72, and pressing firmly, so that still-tacky adhesive 76 re-engages flap sheet 72. Preferably, the material and pattern of adhesive 76 will permit up to 10 or 20 openings and reclosings before final degradation of the releasable adhesive connection.

As described hereinabove, in the preferred embodiment of FIGS. 4–10, separation of the spout flap 73 from base sheet 72 results in the adhesive material remaining on sheet 74, instead of remaining on sheet 72.

Alternatively, spout structure 71 may be configured so that the adhesive 76 remains on the base sheet 72, upon separation of sheet 74 from sheet 72, if so desired.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A bag apparatus, having a repeatedly openable and reclosable pour spout, comprising:

a tubular bag body, fabricated from at least one layer of bag material;

the tubular bag body having at least one end configured to form an open mouth and having first and second opposing sides adjacent the mouth;

the first and second sides of the tubular bag body defining long and short steps, respectively;

a closure flap emanating from the first of the opposing sides of the mouth, and operably configured to be folded along a fold line across the mouth and over at least a portion of an outer surface of the second of the opposing sides of the mouth, and wherein the substantial majority of the width of the short step of the tubular bag body is folded over upon itself;

the closure flap having an inside surface operably configured to be placed in juxtaposed alignment over the at least first portion of the outer surface of the second of the opposing sides of the mouth;

a spout structure, operably affixed to a portion of the outside surface of the tubular bag body, including a base sheet, operably positioned on and over at least a further portion of the portion of the outer surface of the second of the opposing sides of the mouth, the base sheet having an outside surface;

a spout flap, operably disposed in substantially aligned overlying contact with the base sheet;

a first adhesive material operably arranged on at least one of the inside surface of the spout flap and the outside surface of the base sheet and configured to releasably hold the spout flap to the base sheet, after the spout flap and the base sheet have been brought into the substantially aligned overlying contact with each other;

the spout structure being operably disposed on the further portion of the portion of the outer surface of the second of the opposing sides of the mouth, so that upon operable positioning of a second, substantially non-releasable adhesive material upon the inside surface of the closure flap and further upon the juxtaposed alignment of the closure flap over and against the portion of the outer surface of the second of the opposing sides of the mouth, the spout flap becomes non-releasably affixed to a portion of the inside surface of the closure flap;

the short step being provided with a downwardly cut portion, below which the spout structure is positioned, to enable the spout structure to be positioned in close proximity to the fold line, towards preventing contact between the short step and the outer surface of the spout structure, when the closure flap is folded over the fold line;

complete separation of the spout flap from the base sheet enabling a portion of the mouth of the bag to be reopened for providing access to an interior region of the tubular bag body, the first adhesive material permitting the spout flap and base sheet to be repeatedly separated and releasably reattached to one another, to, in turn, permit at least a portion of the mouth to be repeatedly opened and reclosed, whereupon opening of the bag, the first adhesive remains on at least one of the spout flap and the base sheet.

2. The bag apparatus according to claim 1, wherein the spout flap further comprises:

at least first and second flap sheets laminated to one another.

3. The bag apparatus according to claim 2, wherein the at least first and second flap sheets are fabricated from different materials.

4. The bag apparatus according to claim 1, wherein the first adhesive material is disposed to remain on the spout flap, upon separation of the spout flap from the base sheet.

5. The bag apparatus according to claim 1, wherein the first adhesive material is disposed to remain on the base sheet, upon separation of the spout flap from the base sheet.

6. The bag apparatus according to claim 1, wherein the base sheet comprises a sheet, fabricated from a polymer-based material.

7. The bag apparatus according to claim 1, wherein the first adhesive material comprises at least one material from the group consisting of polyesters, polyethylenes, polyamids.

8. The bag apparatus according to claim 1, wherein the spout structure is operably disposed upon the further portion of the portion of the outer surface of the second of the opposing sides of the mouth so that, after the juxtaposed alignment of the closure flap over the portion of the outer surface of the second of the opposing sides of the mouth and non-releasable affixation of the spout flap to the closure flap, upon initial separation of the spout flap and the base sheet, and upon continued pulling of the spout flap, a portion of the closure flap, to which the spout flap is non-releasably affixed, becomes partially separated from a remaining portion of the closure flap, for facilitating partial opening of the mouth of the bag.

9. The bag apparatus according to claim 1, wherein portions of the inside surface of the spout flap and of the base sheet are free of the at least one adhesive material, so that an object may be inserted between the portions of the inside surface of the spout flap and the base sheet, for facilitating grasping of the spout flap, toward permitting pulling of the spout flap away from the base sheet.

10. The bag apparatus according to claim 1, wherein the bag body is formed from a plurality of layers of bag material.

11. The bag apparatus according to claim 1, wherein at least one of the layers of bag material is fabricated from paper.

12. The bag apparatus according to claim 2, wherein at least one of the layers of bag material is fabricated from a plastic material.

13. The bag apparatus according to claim 1, wherein the bag body is gusseted.

14. The bag apparatus according to claim 1, wherein the bag body is fabricated from a plurality of layers of bag material, with the at least one end of the bag being cut to form a stepped end.

* * * * *

UNITED STATES PATENT AND TRADEMARK OFFICE

CERTIFICATE OF CORRECTION

PATENT NO. : 6,328,472 B1
DATED : December 11, 2001
INVENTOR(S) : James B. Laurence et al.

It is certified that error appears in the above-identified patent and that said Letters Patent is hereby corrected as shown below:

Title page,
Please insert Item -- [63] Related U.S. Application Data, Continuation of U.S. Serial No. 09/441,938 filed November 17, 1999, now U.S. Patent No. 6,120,184 issued September 19, 2000. --

Signed and Sealed this

Twentieth Day of May, 2003

JAMES E. ROGAN
*Director of the United States Patent and Trademark Office*